US010622173B2

(12) United States Patent
Hirayama et al.

(10) Patent No.: US 10,622,173 B2
(45) Date of Patent: Apr. 14, 2020

(54) ROCKER SWITCH DEVICE

(71) Applicants: TOYO DENSO CO., LTD., Minato-ku, Tokyo (JP); HONDA MOTOR CO., LTD., Minato-ku, Tokyo (JP)

(72) Inventors: Ikuo Hirayama, Tsurugashima (JP); Kohei Tosa; Kazuhiko Ono, Wako (JP); Katsuhisa Yamada, Wako (JP); Norifumi Shimizu, Wako (JP)

(73) Assignees: Toyo Denso Co., Ltd., Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/346,690

(22) PCT Filed: Oct. 20, 2017

(86) PCT No.: PCT/JP2017/038048
§ 371 (c)(1),
(2) Date: May 1, 2019

(87) PCT Pub. No.: WO2018/088177
PCT Pub. Date: May 17, 2017

(65) Prior Publication Data

US 2019/0267203 A1 Aug. 29, 2019

(30) Foreign Application Priority Data

Nov. 9, 2016 (JP) ..... 2016-219166

(51) Int. Cl.
*H01H 23/14* (2006.01)
*H01H 23/04* (2006.01)
(Continued)

(52) U.S. Cl.
CPC ..... *H01H 23/04* (2013.01); *H01H 9/02* (2013.01); *H01H 23/08* (2013.01); *H01H 23/12* (2013.01); *H01H 23/14* (2013.01); *H01H 23/16* (2013.01)

(58) Field of Classification Search
CPC ..... H01H 23/14; H01H 23/12; H01H 23/04; H01H 23/08; H01H 23/16; H01H 9/02
See application file for complete search history.

(56) References Cited

U.S. PATENT DOCUMENTS 3,529,109 A * 9/1970 Cross ..... H01H 23/12 200/557
4,002,874 A * 1/1977 Brown ..... H01H 9/26 200/321
(Continued)

FOREIGN PATENT DOCUMENTS

JP S57-58230 U 4/1982
JP S62-26839 U 2/1987
(Continued)

*Primary Examiner* — Felix O Figueroa
(74) *Attorney, Agent, or Firm* — Carrier Blackman & Associates, P.C.; Joseph P. Carrier; William D. Blackman

(57) ABSTRACT

A rocker switch device is provided in which a pair of shaft portions are projectingly provided on mutually opposing faces of extremity portions of a pair of side wall parts of a switch case, the pair of shaft portions being aligned on the same axis as each other, a bearing hole is formed in an operating knob so as to extend therethrough, the pair of shaft portions being rotatably fitted into the bearing hole, a projecting portion is provided on an outside face of the pair of side wall parts, the projecting portion being pressed into contact with the support body to thus prevent rattling of the switch case, and a support pin is fitted into the bearing hole, opposite ends of the support pin abutting against extremities
(Continued)

of the pair of shaft portions respectively. Such arrangement prevents switch malfunctioning, and restrains deformation of the side wall parts.

4 Claims, 6 Drawing Sheets

(51) Int. Cl.

| | |
|---|---|
| ***H01H 23/08*** | (2006.01) |
| ***H01H 23/16*** | (2006.01) |
| ***H01H 9/02*** | (2006.01) |
| ***H01H 23/12*** | (2006.01) |

(56) References Cited

U.S. PATENT DOCUMENTS

| | | | | |
|---|---|---|---|---|
| 4,463,228 | A * | 7/1984 | Osika | H01R 13/70 200/43.02 |
| 4,752,661 | A * | 6/1988 | Shimoyama | H01H 23/14 200/339 |
| 7,122,752 | B2 * | 10/2006 | Nagai | B60Q 3/51 200/315 |
| 7,560,656 | B2 | 7/2009 | Okatani et al. | |
| 7,812,275 | B2 * | 10/2010 | Nakamura | B60Q 1/0076 200/339 |
| 8,853,893 | B2 * | 10/2014 | Savicki, Jr. | H01H 23/025 307/140 |
| 10,381,178 | B2 * | 8/2019 | Kumakiri | H01H 23/145 |

FOREIGN PATENT DOCUMENTS

| | | |
|---|---|---|
| JP | 2003-022731 A | 1/2003 |
| JP | 2008-041615 A | 2/2008 |

* cited by examiner

ROCKER SWITCH DEVICE

TECHNICAL FIELD

The present invention relates to a switch device, and in particular to a rocker switch device that includes a switch case that retains a fixed contact and can be joined to a support body, and an operating knob that retains a movable contact and is axially supported on the switch case so that the operating knob can swing, the switch case having a pair of mutually opposing side wall parts with the operating knob sandwiched therebetween, and a linking wall part providing a connection between base portions of the pair of side wall parts.

BACKGROUND ART

As the rocker switch device, for example, one shown in Patent Document 1 below is conventionally known.

RELATED ART DOCUMENTS

Patent Documents

Patent Document 1: Japanese Patent Application Laid-open No. 2008-41615

SUMMARY OF THE INVENTION

Problems to be Solved by the Invention

In a switch case of the above conventional device, a positioning projection (8) engaging with a positioning groove (10) on a support body side is projectingly provided on an outside face of an extremity of a pair of side wall parts, but this projection is only for positioning the switch case with respect to the support body and is not for preventing rattling.

When the conventional device is used for example in an environment in which high vibration acts on the support body, the switch case (in particular, a portion that is spaced from a part fastened to the support body and easily undergoes elastic deformation, for example an extremity of the side wall part) easily rattles due to the high vibration, and there is a possibility that the switch will malfunction, etc. In order to avoid this problem, for example, specially providing a rattling prevention rib on a face opposing the projection (an inner face of the groove) to thus make the projection (and consequently the switch case) be strongly pressed into contact with and fixed to the support body could be considered, but in this case the following other problems will occur.

That is, in the switch case of the conventional device, with regard to the pair of side wall parts in particular, while taking into consideration the light weight, small size, ease of assembly, etc. of the switch case itself, base portions of the side wall parts are joined to each other in a cantilevered manner, and the extremity side of the side wall part is left as a free end (that is, the extremities are not joined to each other). Because of this, in such a conventional structure, in order to prevent rattling of the switch case, for example, when the projection is strongly pressed into contact with the support body, the pressure contact reaction force makes the side wall part undergo elastic deformation to thus strongly press the side wall part against the operating knob side, and not only does this interfere with smooth swinging of the operating knob but there is also a possibility that the problem of the operating knob being fixed and stuck in a pushing operation position (that is, even after the operating knob is released an operated state of the switch will not be changed and is fixed), etc. will occur.

The present invention has been accomplished in light of such circumstances, and it is an object thereof to provide a rocker switch device that can solve the above problems all at once with a simple structure even when it is used in an environment in which its support body is subjected to high vibration.

Means for Solving the Problems

In order to attain the above object, according to a first aspect of the present invention, there is provided a rocker switch device comprising a switch case that retains a fixed contact and can be joined to a support body, and an operating knob that retains a movable contact and is axially supported on the switch case so that the operating knob can swing, the switch case having a pair of mutually opposing side wall parts with the operating knob sandwiched therebetween, and a linking wall part providing a connection between base portions of the pair of side wall parts, characterized in that a pair of shaft portions are projectingly provided on mutually opposing faces of extremity portions of the pair of side wall parts, the pair of shaft portions being aligned on the same axis as each other, a bearing hole is formed in the operating knob so as to extend therethrough, the pair of shaft portions being rotatably fitted into the bearing hole, a projecting portion is provided on an outside face of at least one of the side wall parts, the projecting portion being pressed into contact with the support body to thus prevent rattling of the switch case, and a support pin is fitted into the bearing hole, opposite ends of the support pin abutting against extremities of the pair of shaft portions respectively.

Further, in order to attain the above object, according to a second aspect of the present invention, there is provided a rocker switch device comprising a switch case that retains a fixed contact and can be joined to a support body, and an operating knob that retains a movable contact and is axially supported on the switch case so that the operating knob can swing, the switch case having a pair of mutually opposing side wall parts with the operating knob sandwiched therebetween, and a linking wall part providing a connection between base portions of the pair of side wall parts, characterized in that a pair of shaft portions are projectingly provided on mutually opposing faces of extremity portions of the pair of side wall parts, the pair of shaft portions being aligned on the same axis as each other, a bearing hole is formed in the operating knob so as to extend therethrough, the pair of shaft portions being rotatably fitted into the bearing hole, a projecting portion is provided on an outside face of at least one of the side wall parts, the projecting portion being pressed into contact with the support body to thus prevent rattling of the switch case, and the pair of shaft portions are formed so as to have a length such that mutually opposing extremities of the pair of shaft portions directly abut against each other.

Furthermore, according to a third aspect of the present invention, in addition to the first or second aspect, the switch case is formed dividedly from a first case element having at least either one of the side wall parts and the linking wall part joined integrally to the base portion of the one side wall part, and a second case element having at least the other side wall part, the base portion of the other side wall part being latched on or fastened by a screw to the linking wall part.

Effects of the Invention

As described above, in accordance with the present invention, with regard to the rocker switch device, in which the pair of shaft portions aligned on the same axis as each other are projectingly provided on the mutually opposing faces of the extremity portions of the pair of side wall parts respectively of the switch case, and the bearing hole, into which the shaft portion is rotatably fitted, is formed in the operating knob so as to extend therethrough, since the projecting portion is provided on an outside face of at least one of the side wall parts, the projecting portion being pressed into contact with the support body to thus prevent rattling of the switch case, even when the rocker switch device is used in an environment in which the support body is subjected to high vibration, it becomes possible to prevent effectively the occurrence of a problem such as malfunctioning of the switch due to rattling of the switch case due to the high vibration.

When the projecting portion for preventing rattling is pressed into contact with the support body as described above, in the case of the conventional structure the side wall part of the switch case would undergo elastic deformation due to the reaction force to the pressure contact and be pressed against the operating knob side. However, in accordance with the first aspect of the present invention, since the support pin having its opposite ends abutting against the extremities of the pair of shaft portions is fitted into the bearing hole of the operating knob, it becomes possible to reliably restrain the side wall part from being pressed against the operating knob side by means of the support pin sandwiched between the shaft portions; in accordance with the second aspect, since the pair of shaft portions are formed so as to have a length such that mutually opposing extremities of the two shaft portions directly abut against each other, it becomes possible to reliably restrain the side wall part from being pressed against the operating knob side by means of the shaft portions abutting against each other. As a result, it becomes possible to reliably prevent the occurrence of inconveniences such as interference with the smooth swinging of the operating knob or the switch becoming stuck, etc. due to the above pressing, thereby greatly contributing to improvement of the reliability of the rocker switch device.

Furthermore, in accordance with the first aspect in particular, even for another type of switch device for which the distance between a pair of shaft portions is different, it becomes possible, merely by selecting a support pin corresponding to the distance, to deal with this easily and at low cost. Moreover, in accordance with the second aspect in particular, since only at least one of the shaft portions may be formed longer than that in the conventional structure, and it is unnecessary to especially employ a separate component such as the support pin, etc., this can be dealt with at low cost, and the ease of assembly is further improved.

Moreover, in accordance with the third aspect in particular, while the switch case has a simple split-into-two case structure formed from the first and second case elements, joining of the two case elements can be facilitated, and it thereby becomes possible to contribute to achieving a small size and light weight and improving the ease of assembly for the switch case, and consequently the rocker switch device.

EXPLANATION OF REFERENCE NUMERALS AND SYMBOLS

Figure 1:
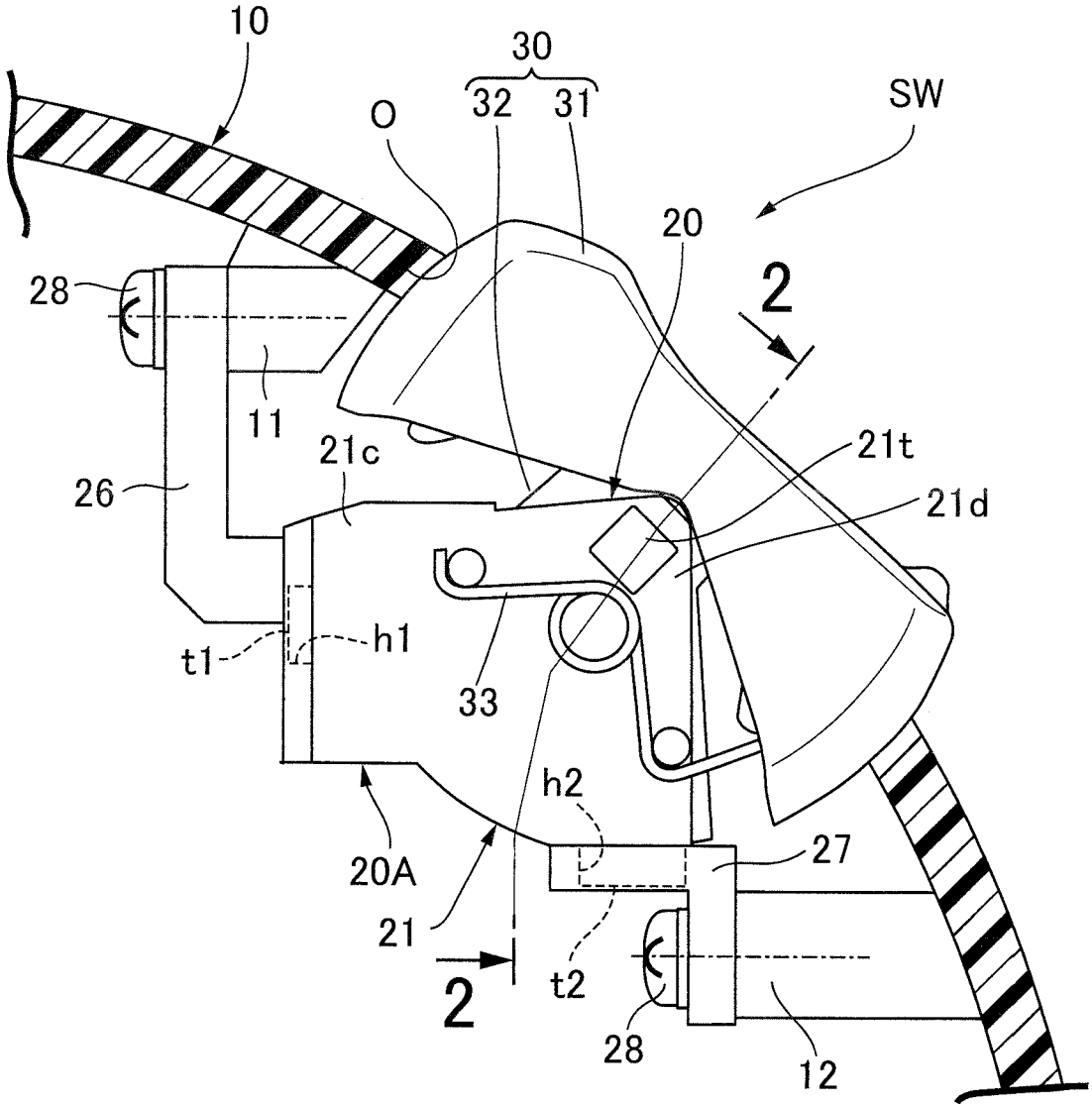
FIG. 1 is a longitudinal sectional view showing a state in which a rocker switch device related to a first embodiment of the present invention is mounted on a handlebar cover. (first embodiment)
Figure 2:
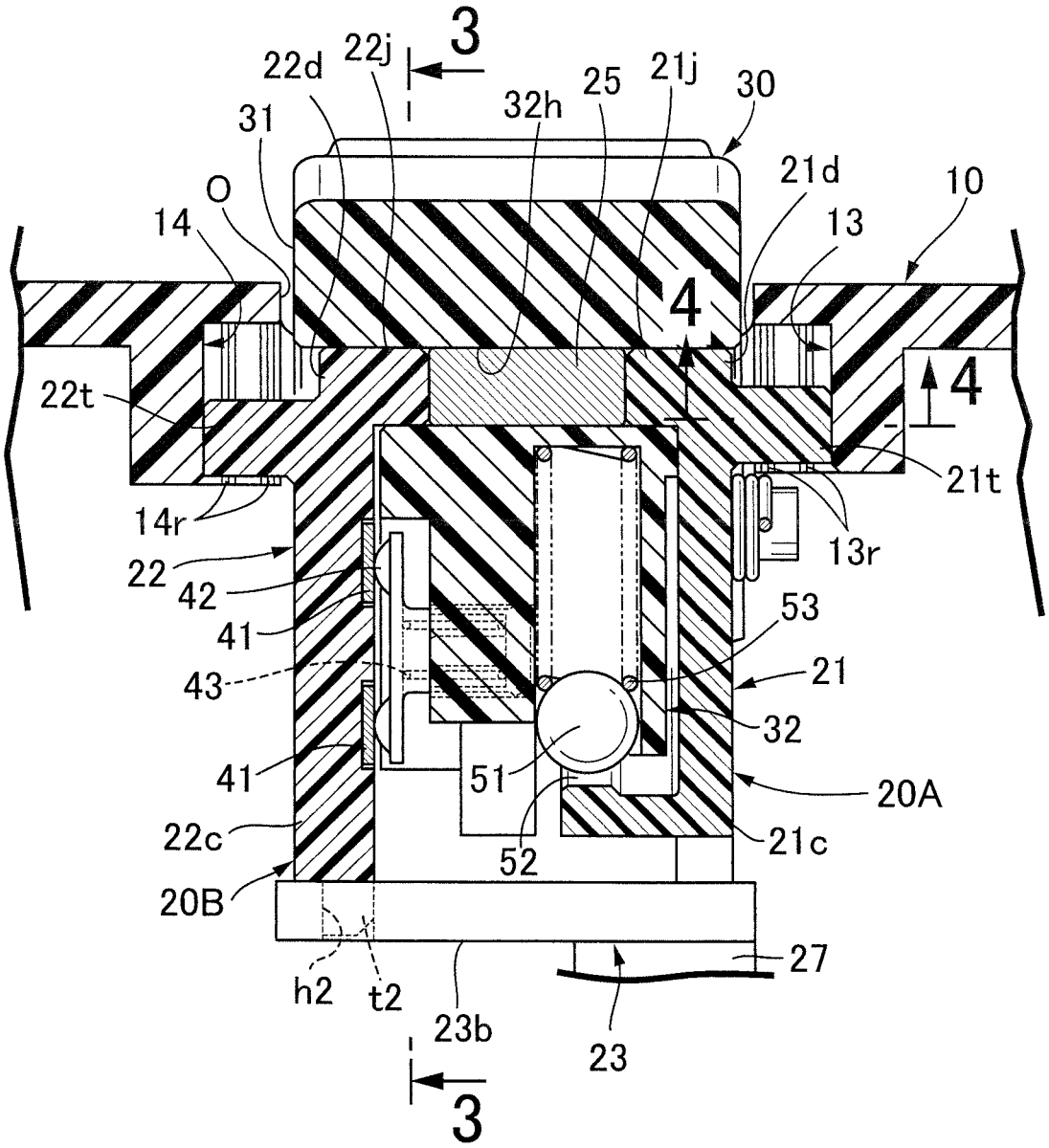
FIG. 2 is an enlarged sectional view along 2-2 in FIG. 1 (reduced sectional view along line 2-2 in FIG. 3). (first embodiment)

SW Rocker switch device
10 Handlebar cover (support body)
13, 14 Support recess
20 Switch case
20A, 20B First and second case elements
21, 22 First and second side wall parts (side wall part)
21*d*, 22*d* Extremity portion of side wall portion
21*c*, 22*c* Base portion of side wall portion
21*j*, 22*j* Shaft portion
21*t*, 22*t* Projecting portion
23 Linking wall part
25 Support pin
30 Operating knob
32*h* Bearing hole
41 Fixed contact
42 Movable contact

MODES FOR CARRYING OUT THE INVENTION

Embodiments of the present invention are explained below by reference to the attached drawings.

First Embodiment

First, in FIG. 1, a rocker switch device SW is provided on a handlebar cover 10 provided on handlebars of a two-wheeled motor vehicle, the rocker switch device SW functioning as a switch for switching between low and high beams of a headlight. The rocker switch device SW forms a rocker switch device of the present invention, and the handlebar cover 10 forms a support body of the present invention.

The rocker switch device SW includes a switch case 20, made of a synthetic resin, that can be joined to the handlebar cover 10, and an operating knob 30, similarly made of a synthetic resin, that has an intermediate part thereof axially supported on the switch case 20 so that it can swing. A plurality of fixed contacts 41 are latched and retained by the switch case 20 as described later.

The majority of the rocker switch device SW is disposed within the handlebar cover 10. Formed in the handlebar cover 10 is a switch opening O, the operating knob 30 having its front face side (a front face part of a knob outer 31 described later) facing the outside through the opening O.

The handlebar cover 10 is fitted and fixed to for example the vicinity of a grip (not illustrated) of the handlebars. A pair of support bosses 11 and 12 are formed integrally with a reverse face of the handlebar cover 10 at a position where they sandwich the switch case 20 therebetween. A pair of support arms 26 and 27 projectingly provided integrally with the switch case 20 are detachably fixed to the pair of support bosses 11 and 12 respectively with for example a bolt 28 screwed into the support bosses 11 and 12 through the support arms 26 and 27.

The operating knob 30 includes the knob outer 31 having an operation face on its front face and a knob inner 32 projectingly provided on a reverse face of the knob outer 31. A display (for example, a picture, a letter, a word, etc.) corresponding to the target of operation by the rocker switch device SW is added to the operation face. A plurality of movable contacts 42 are retained on one side face of the knob inner 32, the movable contacts 42 exhibiting the function of switching in cooperation with the fixed contacts 41. Each movable contact 42 in this embodiment is slidably fitted to and supported on a side part of the knob inner 32 and urged toward the fixed contact 41 side by means of a contact spring 43.

It should be noted here that the knob outer 31 and the knob inner 32 are formed integrally with each other in this embodiment, but the two may be produced as separate components and joined to each other afterwards.

The switch case 20 is formed so as to have a squared U-shaped cross section and includes first and second side wall parts 21 and 22 opposing each other with the knob inner 32 sandwiched therebetween, and a linking wall part 23 providing a connection between base portions 21*c* and 22*c* of the two side wall parts 21 and 22. The linking wall part 23 of this embodiment is formed from a plurality of linking wall portions 23*a* and 23*b* spaced from each other, and the pair of support arms 26 and 27 are projectingly provided integrally with the linking wall portions 23*a* and 23*b* respectively. The linking wall portions 23*a* and 23*b* may be joined to each other as a unit.

The plurality of fixed contacts 41 are latched and retained on an inside face, opposing the operating knob 30 (knob inner 31), of either one of the side wall parts (in this embodiment the second side wall part) 22.

The switch case 20 of the present embodiment is dividedly formed from a first case element 20A that has at least the first side wall part 21 and the linking wall part 23 joined as a unit to the base portion 21*c* of the first side wall part 21, and a second case element 20B that has at least the second side wall part 22. The base portion 22*c* of the second side wall part 22 is disengageably latched on the linking wall part 23. The latching structure is formed for example from latching holes h1 and h2 that are formed in a plurality of linking wall portions 23*a* and 23*b* respectively of the linking wall part 23, and latching claws t1 and t2 that are formed on the base portion 22*c* of the second side wall part 22 and are capable of latching into the latching holes h1 and h2 respectively.

With regard to the latching structure for the second side wall part 22 and the linking wall part 23, instead of the above structure, for example, a latching claw may be provided on the linking wall portions 23*a* and 23*b* and a latching hole may be provided in the base portion 22*c* of the second side wall part 22.

As described above, instead of the structure in which the base portion 22*c* of the second side wall part 22 is latched on the linking wall part 23, the base portion 22*c* of the second side wall part 22 may be detachably joined to the linking wall part 23 by means of a bolt and a nut, which are not illustrated.

A pair of raised parts are formed integrally with the handlebar cover 10 on opposite sides of the switch opening O, and the raised parts are each provided with cutout groove-shaped support recesses 13 and 14 that open on the opening O side and the reverse side of the handlebar cover 10. On the other hand, projecting portions 21*t* and 22*t* are provided integrally with outside faces of extremity portions 21*d* and 22*d* of the first and second side wall parts 21 and 22, the projecting portions 21*t* and 22*t* being press fitted into inside faces of the pair of support recesses 13 and 14 to thus prevent rattling of the switch case 20.

A plurality of rattling-preventing ribs 13*r* and 14*r* are projectingly provided integrally with one inside face of each of the support recesses 13 and 14 respectively, the rattling-preventing ribs 13*r* and 14*r* being capable of being pressed into contact with the corresponding projecting portions 21*t* and 22*t*. These ribs 13*r* and 14*r* extend in parallel with each other so as to follow the direction in which the projecting portions 21*t* and 22*t* are press fitted into the support recesses 13 and 14.

When the support arms 26 and 27 of the switch case 20 are secured to the support bosses 11 and 12 of the handlebar cover 10 with the bolt 28, the pair of projecting portions 21*t* and 22*t* are press fitted into the pair of support recesses 13 and 14 respectively from the reverse side of the handlebar cover 10, and in this process the projecting portions 21*t* and 22*t* are pressed into contact with inside faces, facing three sides, of the support recesses 13 and 14. Therefore, due to the effect of the pressure contact, vibrational rattling of the extremity portions 21*d* and 22*d* of the first and second side wall parts 21 and 22 is suppressed effectively.

The effect of suppressing vibrational rattling can be achieved to some degree even in a case in which the projecting portion 21*t* (or 22*t*) for preventing rattling is provided on one 21 (or 22) of the first and second side wall parts 21 and 22.

A pair of shaft portions 21*j* and 22*j* aligned on the same axis as each other are projectingly provided on mutually opposing faces of the extremity portions 21*d* and 22*d* of the pair of side wall parts 21 and 22 respectively. A bearing hole 32*h* is formed so as to extend through the knob inner 32, the two shaft portions 21*j* and 22*j* being rotatably inserted into the bearing hole 32*h*.

A columnar support pin 25 is slidably fitted into the bearing hole 32*h*, the support pin 25 having opposite ends abutting against extremities of the pair of shaft portions 21*j* and 22*j* (that is, it being held between mutually opposing faces of the pair of shaft portions 21*j* and 22*j*). The support pin 25 is a rigid body and may be formed from for example a metal material, a synthetic resin material, etc. The support pin 25 may be a hollow pin.

Figure 3:
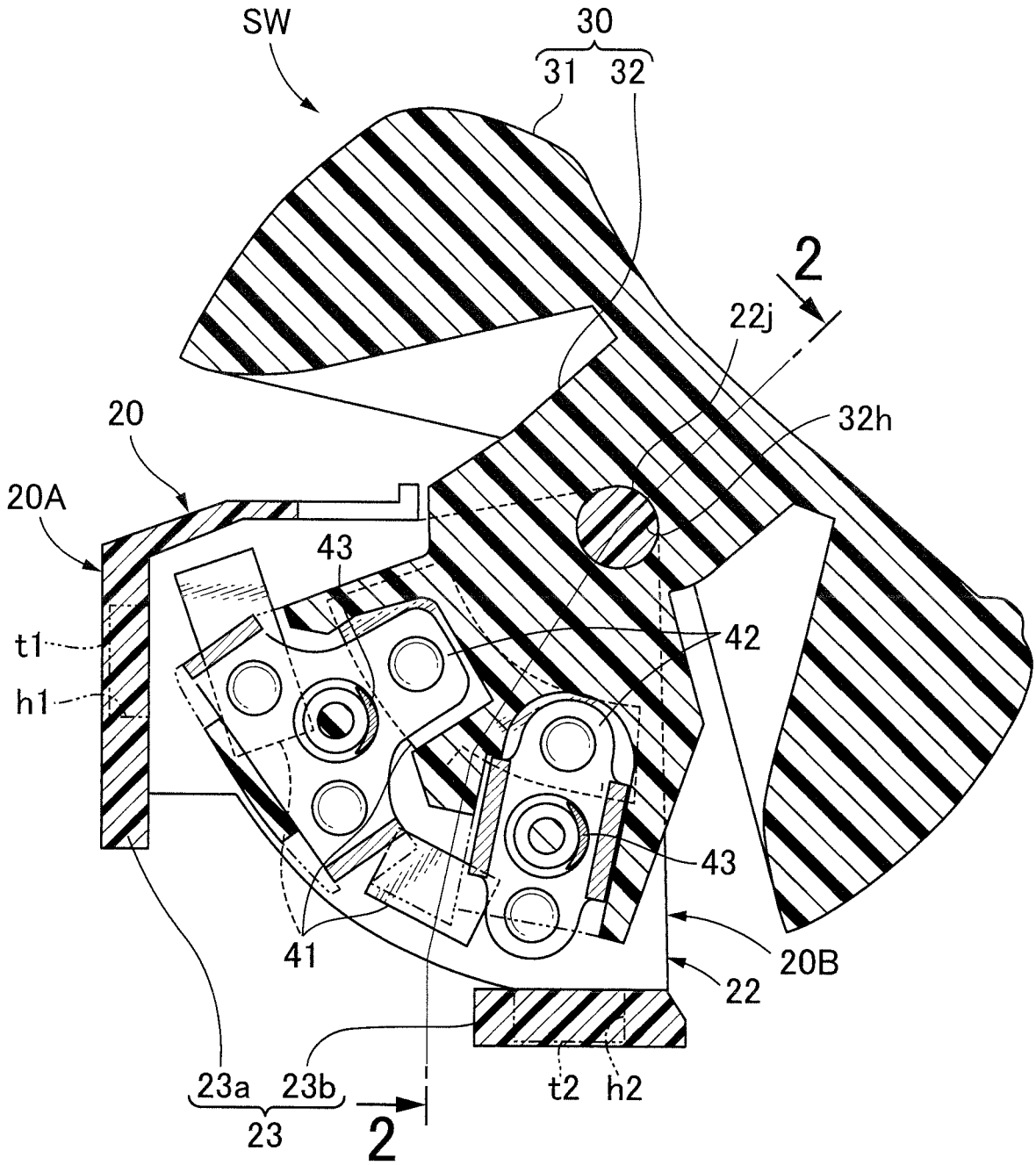
FIG. 3 is a sectional view along line 3-3 in FIG. 2. (first embodiment)
Figure 4:
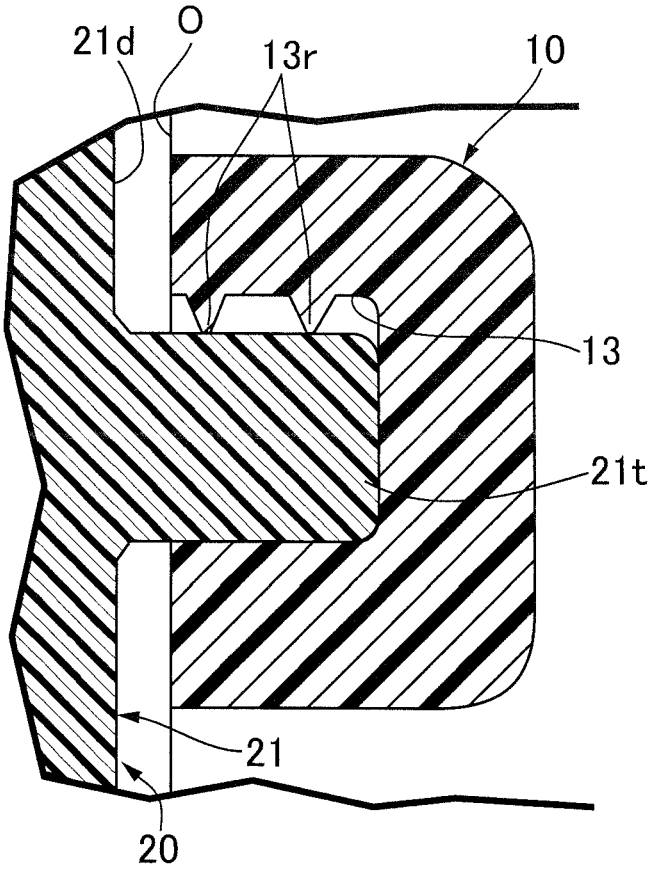
FIG. 4 is an enlarged sectional view along 4-4 in FIG. 2. (first embodiment)
Figure 5:
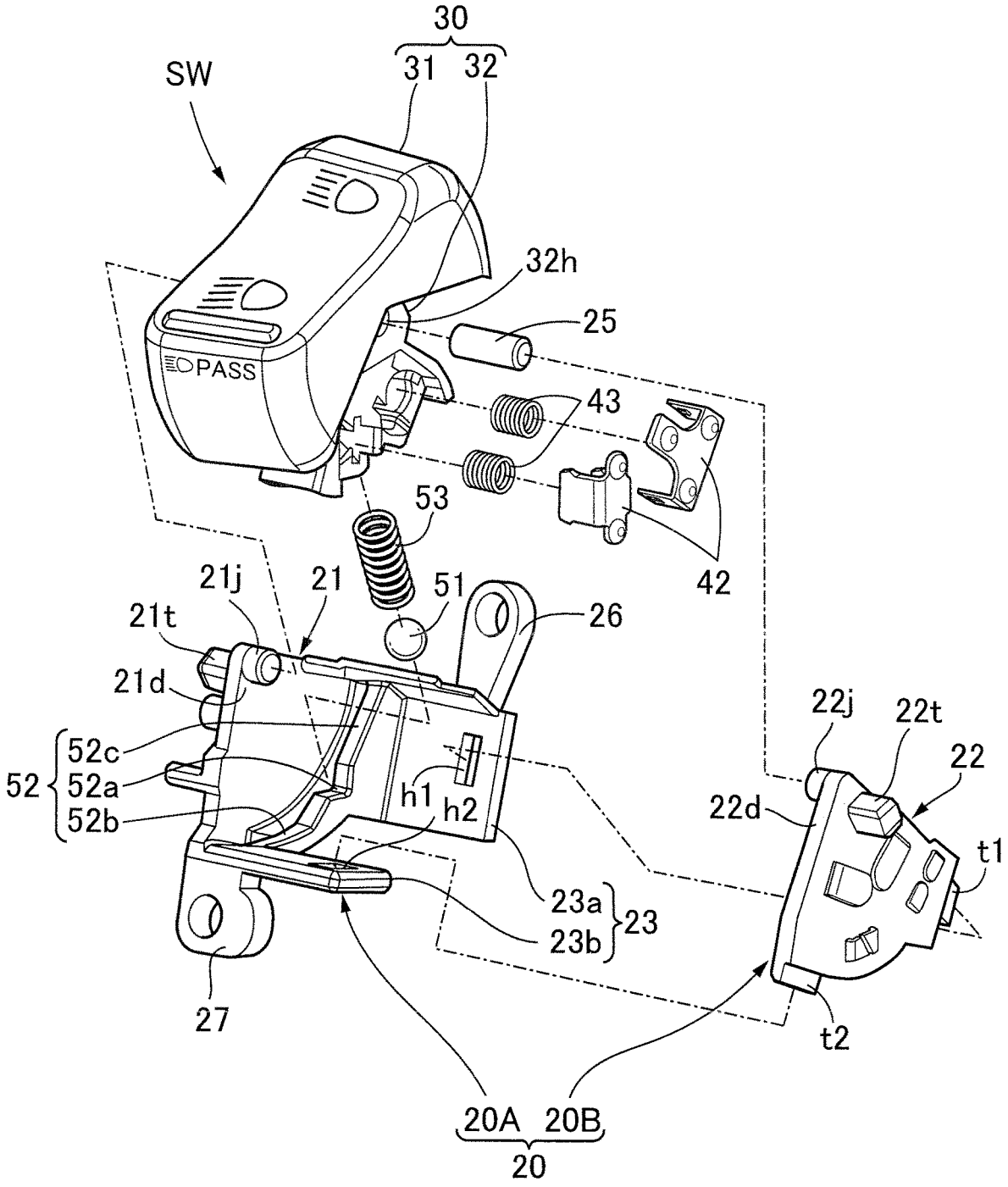
FIG. 5 is an exploded perspective view of the rocker switch device. (first embodiment)

The operating knob 30 is swingably supported on the switch case 20 via the shaft portions 21*j* and 22*j* and the bearing hole 32*h* so as to attain a first operated position (low beam position) shown in FIG. 1 and FIG. 3, a second operated position (high beam position) that is attained by pushing down the deeper side (that is, the top left side in FIG. 1) of the operation face of the operating knob 30 at the first operated position, and a third operated position (passing position) that is attained by pushing down the near side (that is, the bottom right side in FIG. 1) of the operation face of the operating knob 30 at the first operated position.

The operating knob 30 is always urged toward the first operated position side (that is, in the counterclockwise direction in FIG. 1) by means of a return spring 33, which is a torsion coil spring disposed between the operating knob 30 and the switch case 20 (first side wall part 21).

A retaining mechanism 50 is disposed between the operating knob 30 and the switch case 20, the retaining mechanism 50 being capable of retaining the operating knob 30 selectively at the first or second operated position.

The retaining mechanism 50 is formed from a click ball mechanism that includes for example a ball 51 slidably fitted into a support hole of the knob inner 32, a guide face 52 provided on an inside face of the first side wall part 21 so that the ball 51 can roll thereon, and a spring 53 resiliently urging the ball 51 toward the guide face 52. First and second engagement recess portions 52*a* and 52*b* each engaging with the ball 51 at the first and second operated position respectively of the operating knob 30 are provided in the guide face 52 so as to be adjacent to each other in the swing direction of the operating knob 30. Furthermore, an inclined face 52*c* is provided on the guide face 52 at a position adjacent to the side, opposite to the second engagement recess portion 52*b*, of the first engagement recess portion 52*a*, the inclined face 52*c* gradually rising in going away from the first engagement recess portion 52*a*.

When the operating knob 30 is operated to the first operated position, the ball 51 engages with a bottom part of the first engagement recess portion 52*a*, thus retaining the operating knob 30 at the first operated position. When the operating knob 30 at the first operated position is operated toward the second operated position side, the ball 51 moves from the first engagement recess portion 52*a* so as to engage with the second engagement recess portion 52*b*, thus retaining the operating knob 30 at the second operated position. When the operating knob 30 at the first operated position is operated to the third operated position against the resilient force of the return spring 33, since the ball 51 rolls so as to ascend the inclined face 52*c*, if the operating knob 30 is released from the operation state or the operating force is weakened, the operating knob 30 automatically returns to the first operated position by virtue of the resilient force of the return spring 33.

The plurality of fixed contacts 41 are connected to a lighting circuit of a headlight, which is not illustrated. With regard to the plurality of fixed contacts 41 and movable contacts 42, the contact shapes and the positions thereof are set so that when the operating knob 30 is at the first operated position the low beam is lit up, when it is at the second operated position the high beam is lit up, and when it is at the third operated position the low and high beams are simultaneously lit up. They may be set so that only the high beam is lit up at the third operated position.

The operation of the first embodiment is now explained.

With regard to assembly of the rocker switch device SW, the ball 51 and spring 53 of the retaining mechanism 50 and the movable contact 42 and contact spring 43 are each assembled on the knob inner 31 of the operating knob 30, and the support pin 25 is fitted into the bearing hole 32*h*, thus giving the operating knob 30 in a provisionally assembled state.

The operating knob 30 in this provisionally assembled state is sandwiched between the first and second side wall parts 21 and 22 of the switch case 20, the shaft portions 21*j* and 22*j* are fitted through the bearing hole 32*h*, and the latching claws t1 and t2 of the second side wall part 22 are latched into the latching holes h1 and h2 of the linking wall part 23 of the switch case 20, thus integrating the first and second case elements 20A and 20B by latching them to each other. While housing and axially supporting the operating knob 30 in the interior of the switch case 20, assembly of the switch case 20, and consequently assembly of the rocker switch device SW, is thereby completed.

Subsequently, the assembled rocker switch device SW is fixed to the handlebar cover 10. Fixing is carried out by fastening the support arms 26 and 27 of the switch case 20 to the support bosses 11 and 12 respectively of the handlebar cover 10 by means of the bolt 28, and at the same time the projecting portions 21*t* and 22*t* for preventing rattling on the outside face of the first and second side wall parts 21 and 22 are pressed into contact with the handlebar cover 10 (more specifically, press fitted into the support recesses 13 and 14).

Due to the projecting portions 21*t* and 22*t* of the first and second side wall parts 21 and 22 being pressed into contact with the handlebar cover 10 in this way, even when the handlebar cover 10 (and consequently the rocker switch device SW) is subjected to the influence of travel vibration, engine vibration, etc., it is possible to prevent effectively the switch case 20 from rattling and a switching malfunction, etc. from occurring. That is, there is a possibility that merely fixing the switch case 20 to the handlebar cover 10 by means of the bolt 28 will not reliably prevent vibration of the switch case 20 at a position spaced from the fixed position, but such vibration can be prevented effectively by making the projecting portions 21*t* and 22*t* for preventing rattling positioned on the extremity portions 21*d* and 22*d* (that is, free end parts) of the first and second side wall parts 21 and 22 be pressed into contact with the handlebar cover 10 as described above.

When the projecting portions 21*t* and 22*t* for preventing rattling are pressed into contact with the handlebar cover 10 (more specifically, the support recesses 13 and 14), in the case of the conventional structure first and second side wall parts 21 and 22 would undergo elastic deformation due to the reaction force of the pressure contact and be strongly pressed against the operating knob 30 side. However, in accordance with the present embodiment, the columnar support pin 25 is fitted into the bearing hole 32*h*, which is formed so as to extend through the operating knob 30 (knob inner 32) and has the shaft portions 21*j* and 22*j* of the first and second side wall parts 21 and 22 rotatably fitted therethrough, the columnar support pin 25 having its opposite ends abutting against the extremities of the pair of shaft portions 21*j* and 22*j*.

It thereby becomes possible to reliably restrain the first and second side wall parts 21 and 22 from undergoing elastic deformation as above and being strongly pressed against the operating knob 30 side by virtue of the bracing effect of the support pin 25 between the shaft portions 21*j* and 22*j*, and it becomes possible to reliably prevent the occurrence of inconveniences such as interference with the smooth swinging of the operating knob 30 or the switch becoming stuck, etc. as a result of the above pressing, thereby improving the reliability of the rocker switch device SW. Moreover, in the present embodiment, even for another type of rocker switch device for which the distance between the pair of shaft portions 21*j* and 22*j* is different, it becomes possible, by selecting a support pin 25 corresponding to the distance, to deal with this easily and at low cost.

Furthermore, the switch case 20 of the present embodiment is dividedly formed from the first case element 20A, which has at least the first side wall part 21 and the linking wall part 23 joined as a unit to the base portion 21*c* of the first side wall part 21, and the second case element 20B, which has at least the second side wall part 22, and the base portion 22*c* of the second side wall part 22 is disengageably latched with the linking wall part 23. Because of this, while the switch case 20 has a simple split-into-two case structure formed from the first and second case elements 20A and 20B, joining and separating the two case elements 20A and 20B can be facilitated, and it thereby become possible to achieve a small size and light weight and improve the ease of assembly and maintenance for the switch case 20, and consequently the rocker switch device SW.

Second Embodiment

Figure 6:
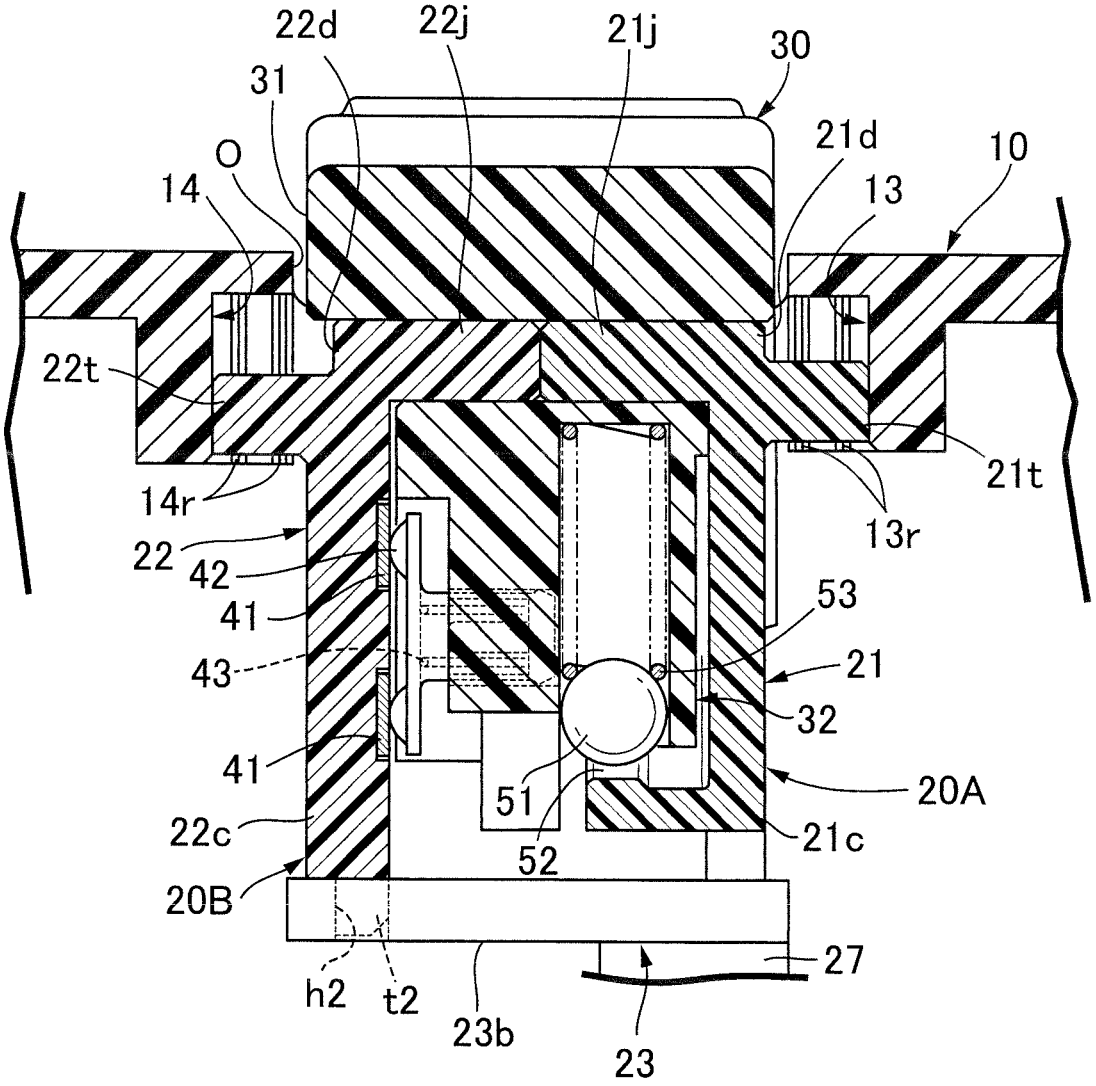
FIG. 6 is a sectional view (view corresponding to FIG. 2) of an essential part of a rocker switch device related to a second embodiment of the present invention. (second embodiment)

A second embodiment of the present invention is now explained by reference to FIG. 6. In order to prevent the first and second side wall parts 21 and 22 from undergoing elastic deformation and being strongly pressed against the operating knob 30 side by the reaction force of the pressure contact that the projecting portions 21*t* and 22*t* for preventing rattling receive from the handlebar cover 10, in the first embodiment the rigid support pin 25 is sandwiched between the pair of shaft portions 21*j* and 22*j* of the first and second side wall parts 21 and 22; in the second embodiment the pair of shaft portions 21*j* and 22*j* are formed so as to have a length such that mutually opposing extremities of the pair of shaft portions 21*j* and 22*j* directly abut against each other. This enables the support pin 25 of the first embodiment to be omitted in the second embodiment.

The arrangement of the second embodiment is otherwise basically the same as that of the first embodiment; component members corresponding to those of the first embodiment are denoted by the same reference numerals and symbols, explanation of specific structures thereby being omitted.

In accordance with the second embodiment, since the mutually opposing extremities of the pair of shaft portions 21*j* and 22*j* of the first and second side wall parts 21 and 22 directly abut against each other within the bearing hole 32*h*, due to the shaft portions 21*j* and 22*j* directly abutting against each other it becomes possible to reliably restrain the first and second side wall parts 21 and 22 from being strongly pressed against the operating knob 30 side. Moreover, the shaft portion of at least one of the pair of shaft portions 21*j* and 22*j* of the first and second side wall parts 21 and 22 (in the present embodiment the two shaft portions 21*j* and 22*j*) is simply formed so as to be longer than the conventional structure (see first embodiment), and since unlike the first embodiment it is unnecessary to especially employ a separate component such as the support pin 25, etc., this can be dealt with at low cost, and the ease of assembly is further improved.

In the second embodiment, an example in which the shaft portions 21*j* and 22*j* have the same length is illustrated, but the shaft portions 21*j* and 22*j* may have a length that enables at least the extremities thereof to directly abut against each other within the bearing hole 32*h*, and the length may freely be set. For example, the length of one shaft portion 21*j* (or 22*j*) may be short as in the first embodiment, and only the length of the other shaft portion 22*j* (or 21*j*) may be sufficiently longer than that in the first embodiment.

In accordance with the second embodiment, the same operational effects as those of the first embodiment described above can be achieved.

Embodiments of the present invention are explained above, but the present invention may be modified in a variety of ways as long as the modifications do not depart from the spirit and scope thereof.

For example, in the embodiments, the rocker switch device SW is illustrated as a switch for low/high switching of a headlight mounted on the handlebars (more specifically the handlebar cover 10) of a two-wheeled motor vehicle, but the rocker switch device of the present invention may be applied to various types of switches other than the switch for low/high switching (e.g. a starter switch, etc.) and may be mounted on a position other than the handlebars of a two-wheeled motor vehicle.

Furthermore, the rocker switch device of the present invention may be applied to a vehicle other than a two-wheeled motor vehicle (e.g. a four-wheeled motor vehicle) or various types of machines other than a vehicle.

Moreover, in the embodiments a switch structure is shown in which the first and second operated positions of the operating knob 30 of the rocker switch device SW are retained by means of the retaining mechanism 50, and the third operated position is not retained and is automatically returned to the first operated position side, but the present invention is not limited to the switch structure of the embodiment and may be applied to various types of rocker switch devices. For example, it may be applied to a switch structure in which an operating knob is retained at all operated positions and also may be applied to a switch structure in which if the hand is released after operating an operating knob to either a first or second operated position, the operating knob is automatically returned to an intermediate operated position (neutral position).

Furthermore, the shape of the projecting portions 21*t* and 22*t* for preventing rattling provided on the switch case 20 and the shape of a pressure contact part of the handlebar cover 10 that the projecting portions 21*t* and 22*t* are pressed into contact with (more specifically the support recesses 13 and 14) are not limited to the shapes of the embodiment. That is, the structure may be modified in a variety of ways as long as vibrational rattling of the switch case 20 can be prevented at least by the pressure contact and there is a possibility of the occurrence of the inconvenience that the reaction force to the pressure contact will cause the first and second side wall parts 21 and 22 to be pressed against the operating knob 30 side (that is, the technical problem of the present invention).

Moreover, in the embodiments, the first case element 20A of the switch case 20, which is split into two, is formed by connecting the linking wall part 23 integrally with the first side wall part 21, but in the present invention the linking wall part 23 may be connected integrally with the second side wall part 22 as part of the second case element 20B. Alternatively, the first and second side wall parts 21 and 22 and the linking wall part 23 may be components that are independent from each other (that is, the switch case 20 is split into three), the components may be latched or bolted to each other, or the first and second side wall parts 21 and 22 and the linking wall part 23 may be formed together as a unit.

The invention claimed is:

1. A rocker switch device comprising a switch case that retains a fixed contact and can be joined to a support body, and an operating knob that retains a movable contact and is axially supported on the switch case so that the operating knob can swing, the switch case having a pair of mutually opposing side wall parts with the operating knob sandwiched therebetween, and a linking wall part providing a connection between base portions of the pair of side wall parts, wherein a pair of shaft portions are projectingly provided on mutually opposing faces of extremity portions of the pair of side wall parts, the pair of shaft portions being aligned on the same axis as each other, a bearing hole is formed in the operating knob so as to extend therethrough, the pair of shaft portions being rotatably fitted into the bearing hole, a projecting portion is provided on an outside face of at least one of the side wall parts, the projecting portion being pressed into contact with the support body to thus prevent rattling of the switch case, and the pair of shaft portions are formed so as to have a length such that mutually opposing extremities of the pair of shaft portions directly abut against each other.

2. The rocker switch device according to claim 1, wherein the switch case is formed dividedly from a first case element having at least either one of the side wall parts and the linking wall part joined integrally to the base portion of said one side wall part, and a second case element having at least the other side wall part, the base portion of said other side wall part being latched on or fastened by a screw to the linking wall part.

3. A rocker switch device comprising a switch case that retains a fixed contact and can be joined to a support body, and an operating knob that retains a movable contact and is axially supported on the switch case so that the operating knob can swing, the switch case having a pair of mutually opposing side wall parts with the operating knob sandwiched therebetween, and a linking wall part providing a connection between base portions of the pair of side wall parts, wherein a pair of shaft portions are projectingly provided on mutually opposing faces of extremity portions of the pair of side wall parts, the pair of shaft portions being aligned on the same axis as each other, a bearing hole is formed in the operating knob so as to extend therethrough, the pair of shaft portions being rotatably fitted into the bearing hole, a projecting portion is provided on an outside face of at least one of the side wall parts, the projecting portion being pressed into contact with the support body to thus prevent rattling of the switch case, and a support pin is fitted into the bearing hole, opposite ends of the support pin abutting against extremities of the pair of shaft portions respectively.

4. The rocker switch device according to claim 3, wherein the switch case is formed dividedly from a first case element having at least either one of the side wall parts and the linking wall part joined integrally to the base portion of said one side wall part, and a second case element having at least the other side wall part, the base portion of said other side wall part being latched on or fastened by a screw to the linking wall part.

* * * * *